US005537939A

United States Patent [19]

Horton

[11] Patent Number: 5,537,939

[45] Date of Patent: Jul. 23, 1996

[54] CUTTING AND EMBROIDERY PROCESS

[75] Inventor: Norman Horton, Nottinghamshire, United Kingdom

[73] Assignee: Cadcam Technology Limited, Nottingham, United Kingdom

[21] Appl. No.: 338,478

[22] PCT Filed: May 14, 1993

[86] PCT No.: PCT/GB93/00994

§ 371 Date: Nov. 15, 1994

§ 102(e) Date: Nov. 15, 1994

[87] PCT Pub. No.: WO93/22944

PCT Pub. Date: Nov. 25, 1993

[30] Foreign Application Priority Data

May 16, 1992 [GB] United Kingdom ..... 9210521

[51] Int. Cl.[6] ..... D05B 21/00; D05C 5/04; A41H 43/00

[52] U.S. Cl. ..... 112/475.19; 112/102.5

[58] Field of Search ..... 112/121.12, 121.11, 112/103, 266.1, 262.3, 475.19, 475.18, 475.04, 475.05, 470.01, 470.06, 470.07, 102.5

[56] References Cited

U.S. PATENT DOCUMENTS

| | | | |
|---|---|---|---|
| 4,341,169 | 7/1982 | Mainot et al. | 112/121.12 |
| 4,526,116 | 7/1985 | Mannel | 112/121.12 X |
| 4,561,127 | 12/1985 | Gerber | 2/243 R |
| 4,920,902 | 5/1990 | Takenoya et al. | 112/121.12 X |
| 5,205,232 | 4/1993 | Sadeh et al. | 112/121.12 X |
| 5,323,722 | 6/1994 | Goto et al. | 112/121.12 |

FOREIGN PATENT DOCUMENTS

| | | |
|---|---|---|
| 2659264 | 9/1991 | France . |
| 86/06423 | 11/1986 | WIPO . |

*Primary Examiner*—Peter Nerbun

*Attorney, Agent, or Firm*—Marshall, O'Toole, Gerstein, Murray & Borun

[57] ABSTRACT

A process for reproducing a design, especially a fabric design comprising an embroidered appliqué element stitched to a base fabric material, comprises the sequential steps of analyzing the design to derive data for use as stitch command data by an embroidery machine, and as cutting command data by a cutting machine, cutting out an appliqué element from a sheet material in accordance with the cutting command data, transferring the cut-out appliqué element to the base material and stitching the appliqué element to a base material in accordance with the stitch command data. The invention provides a far quicker, more accurate and neater embroidered appliqué fabric than prior semi-manual techniques.

8 Claims, 2 Drawing Sheets

CUTTING AND EMBROIDERY PROCESS

DESCRIPTION

Technical Field

The invention relates to the control of cutting and embroidery machines and particularly to the control of such machines for reproducing designs incorporating appliqué elements.

Background of the Invention

Computer control of embroidery machines is well known. Control may be either direct or via a program stored on a punched tape, as described in patent document EP-B-0221163 for example. Such computer controlled embroidery machines have been used for generating designs incorporating appliqué elements, for example in which shaped elements of one sheet material (the appliqué elements) are attached to a base of the same or a different sheet material by stitching in the embroidery machine.

The sequence of steps in generating prior art appliqué designs has been as follows. First a representation of the desired design is entered into the computer by means of a design program or a video input or by other well-known methods. The computer, under the direction of an operator, uses the representation of the design to derive stitch command data for the embroidery machine. The operator may in certain cases manipulate the design, for example by rotation or enlargement, before the stitch command data are generated. A sufficiently large sheet of the appliqué material is placed over the base material in the embroidery machine and, in response to the stitch command data from the computer, the embroidery machine stitches through both layers an outline of the desired shape of the appliqué element. A human operator then trims the appliqué material around this outline and, once trimming is complete, further stitching may be carried out under computer control, for example to hide the edges of the appliqué element or to add further detail.

The labour-intensive nature of the manual trimming operation described above is clear. The more complex the outline of the appliqué element, the more difficult is the trimming operation and where the outline is not a simple closed curve, for example with a ring-shaped appliqué element, the above procedure may not be practical at all. Furthermore, it is very wasteful of material to begin each appliqué operation with a plain sheet of appliqué material, much of which must subsequently be trimmed away.

THE INVENTION

The invention provides a process for reproducing a design, comprising the steps of analyzing the design to derive data for use as stitch command data by an embroidery machine and as cutting command data by a cutting machine, cutting out an appliqué element from a sheet material in accordance with the cutting command data, transferring the cut-out appliqué element to a base material and stitching the appliqué element to the base material in accordance with the stitch command data.

One preferred process according to the invention includes the further step of stitching a markout pattern on the base material in accordance with the stitch command data, before the steps of transferring the cut-out appliqué element to the base material and stitching the appliqué element to the base material. The markout pattern indicates the correct location of the appliqué element. The step of stitching the appliqué element to the base material may be followed by a step in which further decorative stitching is applied to the appliqué element, after it has been stitched to the base material, also in accordance with the stitch command data.

A rear surface of the sheet from which the appliqué element is cut is preferably pre-coated with an adhesive in order to assist initial location of the cut-out appliqué element on the base material. This may be sprayed on or applied as a liquid. Preferably the adhesive layer is used initially to secure the entire sheet from which the appliqué is to be cut to a backing layer from which the appliqué element can easily be peeled. A suitable material for the backing layer could be craft paper or vinyl.

The cutting machine for cutting the appliqué element from the sheet material may be a laser cutter which cuts through the appliqué element from above. Alternatively a suitable bladed cutter can be used instead of the laser cutter. Laser cutters are very high precision tools, and may be set, if desired, to cut through both the appliqué element and its backing layer or alternatively, if desired, to cut through the appliqué element but not the backing layer. If the former laser setting is chosen, the appliqué element may be removed from the backing layer with its own piece of backing layer still adhering to it, and that backing layer piece may be removed by peeling immediately before the cut-out appliqué element is transferred to the base material. Some peelable adhesives are available which will remain on the backing layer when the cut-out appliqué element is peeled off, and that may be desirable in some circumstances when the user wants a part of the appliqué element to hang free like a flap or pocket after the appliqué element is stitched to the base material. If the latter laser setting is chosen, so that the laser does not cut deeply enough to cut through the backing layer, then, after cutting the appliqué element together with its adhesive coating can be peeled away from the backing layer, leaving the backing layer intact.

If the cutter is a laser cutter, interesting surface effects and textures can be obtained by programming the cutting machine to cut partially through the appliqué element to obtain an etched surface, in addition to the cutting of the outline. For example, if the appliqué sheet material is a felt or a pile fabric, its surface can be contoured using the laser cutter as part of the same pre-programmed cutting operation that produces the cut outline. A similar treatment of a thermoplastic sheet of appliqué material such as a vinyl or simulated leather sheet, can also produce interesting surface effects.

A further optional modification to the process of the invention comprises analyzing the original design to derive data for use as sign painting data by a numerically controlled painting machine, and painting a design on the sheet material either before or after the cutting operation on the cutting machine, but before transferring the cut-out appliqué element to the base material. The design painted on the sheet material may be in one or more colours and may, for example, represent a selective shading of parts of the sheet material which are to be cut out as the appliqué elements. A numerically controlled air brush painting machine is ideal for this purpose.

Generally the analysis of the design to derive the data from which the stitch command data and cutting command data are generated will be carried out in a computer. Because the computer can control the painting machine (when used) and both the cutting machine and the embroidery machine using similar software, the process is very efficient. The data representing the design can be easily manipulated in the computer to alter the design before the stitch, optional painting and cutting command data are generated. The appliqué element is cut to the required shape before being transferred to the base material, and the embroidery machine can be controlled to mark out the same shape or relevant parts of the shape on the base material prior to the transfer of the appliqué element, which makes location of the appliqué element extremely quick and simple, particularly when it is backed with adhesive. The need to trim around the element is completely eliminated so the process is much faster and more complicatedly shaped elements can be used than with the prior art process. The cutting machine can be controlled so that the layout of the elements cut from the sheet material gives rise to little wastage.

THE DRAWINGS

DETAILED DESCRIPTION

Figure 1:
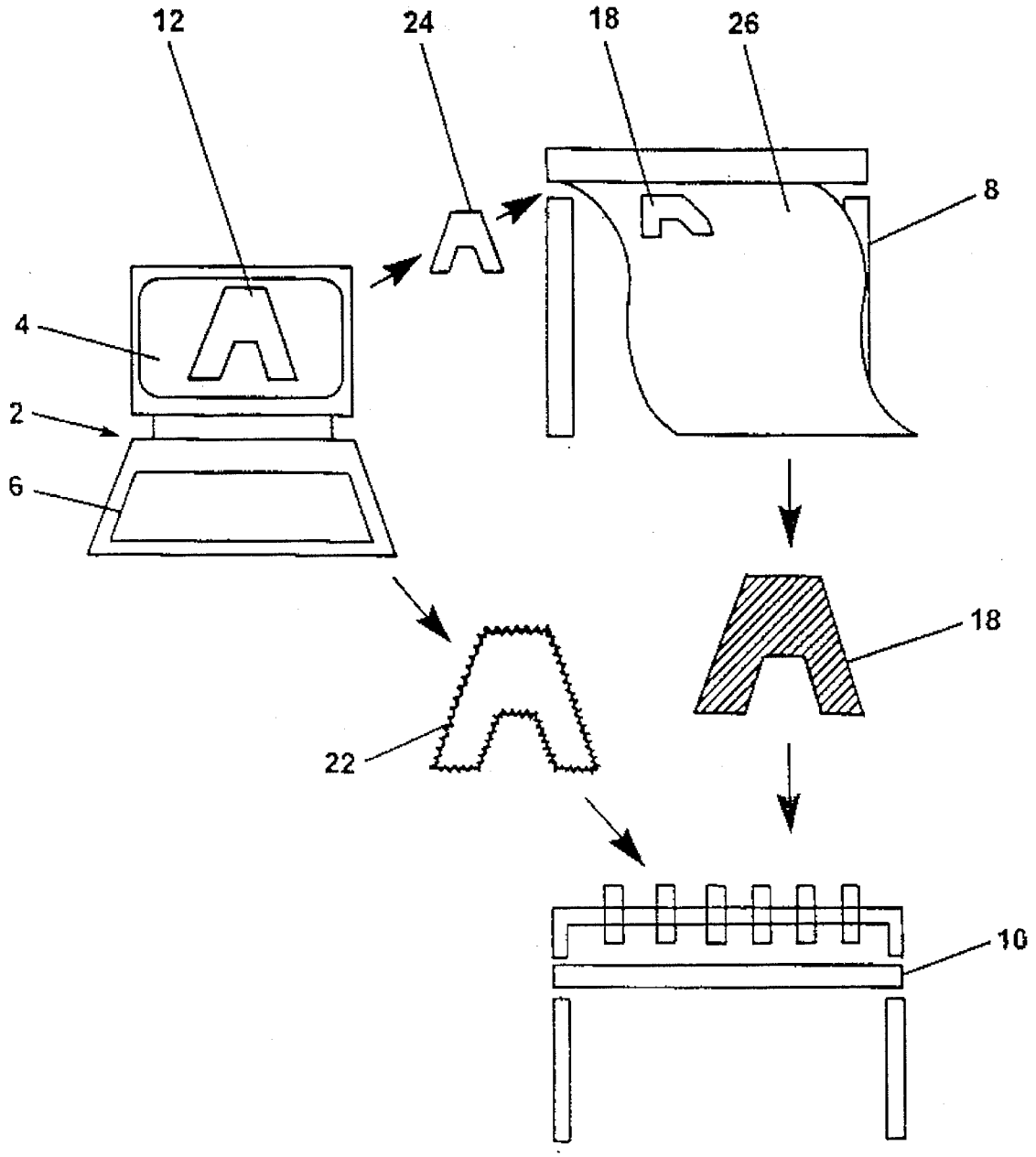
FIG. 1 is a schematic illustration of the apparatus with which the process of the invention is carried out.

In FIG. 1 can be seen the main components of one system with which the process of the present invention may be put into effect. A computer 2, including a screen 4 and keyboard 6, is in communication with a cutting machine 8 and an embroidery machine 10. A design which it is desired to reproduce using an appliqué element is entered into the computer 2, using a design program operated from the keyboard 6 or an input from a video camera (not shown) or by any other well-known means. In the drawings, the design is illustrated by way of example as a shape similar to a capital letter A. Once entered into the computer 2, the design 12 may be manipulated using conventional processing techniques under the control of a human operator, for example to change its size, proportions or orientation. The basic design 12 is processed in various ways using software to generate command data for controlling the cutting and embroidery machines.

The first processing step is to select the outline and optional surface contours of the design 12 that will be cut out in the appliqué material. The software for this process includes means for line and curve entry and for text generation (so that the appliqué elements may easily be made characters of text).

Figure 2:
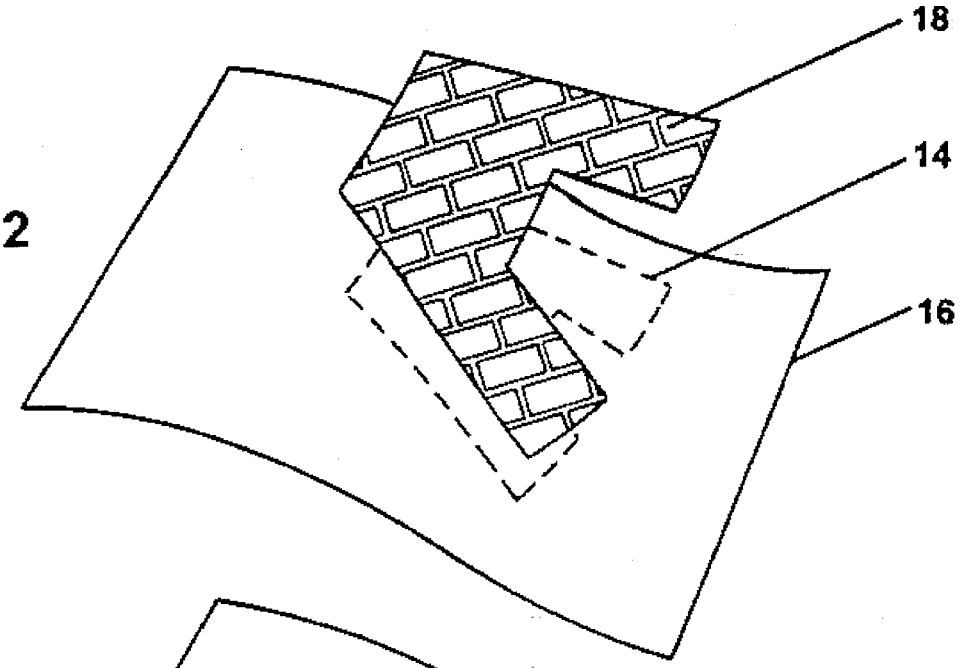
FIGS. 2 to 4 illustrate a sequence of three steps in the process of the invention.

Once the operator is content with the form of the cutting outline for the appliqué element, certain components of the design outline are selected for use as markout guides. From these selected components, the computer 2 generates stitch command data to be sent to the embroidery machine 10. These data control the machine 10 to produce a pattern of stitches 14 on the base material 16, which stitches indicate the correct location for the appliqué element 18, as shown in FIG. 2. In the simplest case the markout pattern 14 will be the entire outline of the appliqué element 18 but in some cases it may be sufficient to mark out only certain significant features of the outline.

It is also necessary for the operator to enter into the computer 2 some form of reference by which the embroidery machine 10 can be correctly positioned before the markout stitches 14 are produced. This reference will be incorporated in the stitch command data.

The next stage of the process is for the operator to use the design processing software of the computer 2 to determine the desired layout of fixing stitches 20 that will hold the appliqué element 18 to the base material 16. The fixing stitches 20 may be of two types: a first, primarily functional pattern of stitches to hold the appliqué element firmly in position and a second, decorative pattern of stitches which will typically hide the edge of the element 18 but may also be located inside or outside the outline of the element. The first pattern of fixing stitches 20 may be necessary because the embroidering of the decorative stitches can distort the appliqué element if it is not firmly held in position. The desired layout and sequence of fixing stitches 20 having been selected, the computer generates from data representing the design 12 a suitable further sequence of stitch command data, schematically illustrated at 22 in FIG. 1.

Many features of the software are common to the processes of defining the markout and fixing stitches, such as the selection of and movement between components of the outline of the design 12. These features may also be employed in the process of selecting the outline for cutting out the appliqué element 18.

The preparation stage is now complete and the production of the appliqué design in as many copies as desired can begin. The computer 2 sends cutting command data, schematically illustrated at 24 in FIG. 1, to the cutting machine 8, to cause the cutting machine to cut the outline of an appliqué element 18 in accordance with the design 12 from a sheet 26 of suitable material. The sheet 26 may be a laminate comprising a backing layer of craft paper or vinyl, coated with an adhesive and covered with an outer layer of flock material. The cutting machine 8 employs a laser beam to cut through the flock material and adhesive layer without penetrating the backing layer so that the sheet as a whole remains intact. The cut appliqué element 18 can then be peeled away from the backing layer, ready coated with adhesive, when it is needed.

Figure 3:
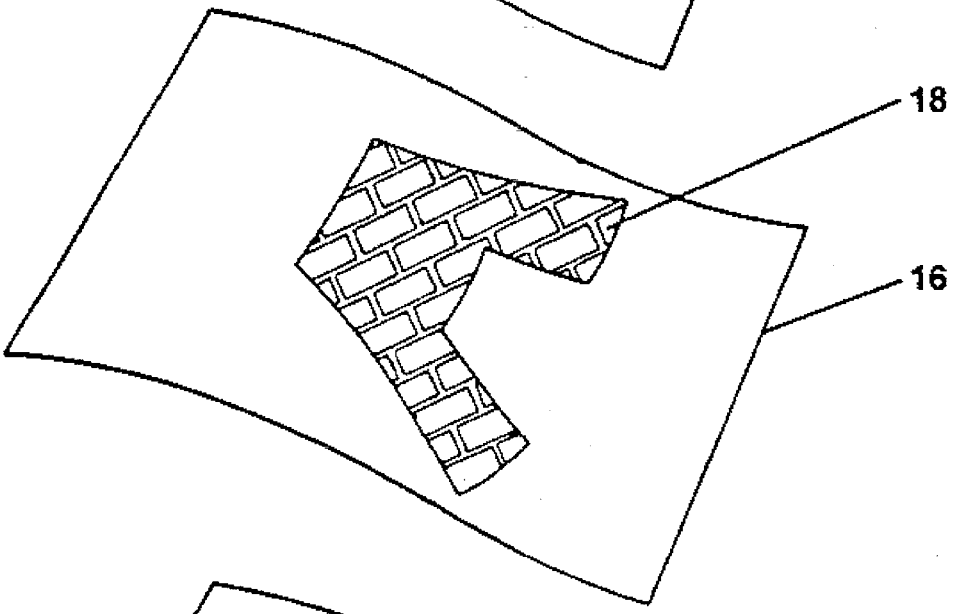
Figure 4:
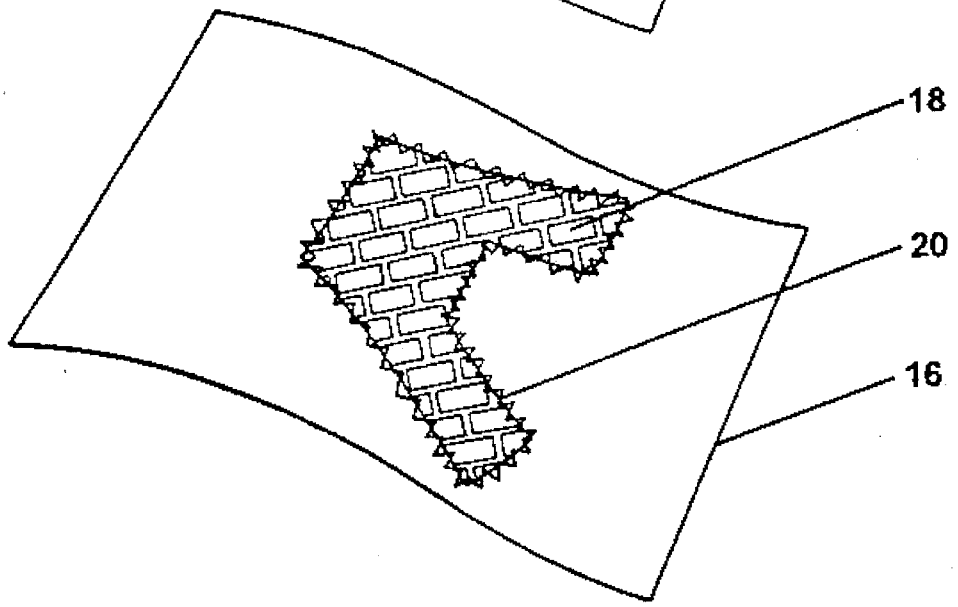

Meanwhile, the computer 2 sends the stitch command data 22 to the embroidery machine 10. The first step controlled by the stitch command data is the correct positioning of the sheet 16 of base material by the embroidery machine 10 and the generation of the selected pattern of markout stitches 14 (FIG. 2). The cut appliqué element 18 is then manually removed from its sheet 26 and affixed to the base material sheet 16 in the embroidery machine 10, at the location indicated by the markout pattern 14 and being held in place by the adhesive (FIG. 3). The embroidery machine 10 then applies the fixing stitches 20 to the appliqué element, further in accordance with the stitch command data to complete the appliqué design (FIG. 4).

I claim:

1. A process for the creation and sewing of the design of an appliqué material to a base material, comprising the steps of:

creating the design on a computer screen;

analyzing the design so created to derive (a) cutting command data for use by a cutting machine, and (b) stitch command data for use by an embroidery machine;

automatically cutting the design from appliqué material using a cutting machine acting in response to the cutting command data; and automatically edge-embroidering over the cut edges of the appliqué material using an embroidery machine acting in response to the stitch command data.

2. A process according to claim 1, wherein the stitch command data includes command data for the straight sewing of the appliqué material to the base material within the confines of the cutting line, and the process further comprises the step of automatically straight sewing the appliqué material to the base material to hold it to the base material during the edge-embroidery step.

3. A process according to claim 1, further comprising the process step of transferring the cut-out appliqué element to the base material after the cutting step and attaching the cut-out material to the base material by adhesive prior to straight-sewing the appliqué element to the base material and subsequently edge-embroidering over the cut edges, the straight-sewing and edge-embroidering being in response to the said stitch command data.

4. A process according to claim 3, wherein the adhesive is a pre-coated adhesive backing on the appliqué material.

5. A process according to claim 4, wherein the appliqué material is adhesively mounted on a backing layer from which it is peeled prior to its transfer to the base material.

6. A process according to claim 1, wherein the cutting machine is a laser cutter capable of either cutting completely through the appliqué material or etching part-way through the appliqué material to create a surface contour or pattern; the step of analyzing the design includes the derivation of etching command data for use by the laser cutter; and the process further comprises the step of automatically etching the surface of the appliqué material in response to the etching command data.

7. A process for reproducing a design, comprising the steps of:

analyzing the design to derive (a) data for use as stitch command data by an embroidery machine, (b) data for use as cutting command data by a cutting machine, and (c) data for use as sign painting data by a sign painting machine;

automatically cutting out an appliqué element from a sheet material in accordance with the cutting command data;

before or after the cutting step, automatically painting a design on the sheet material in accordance with the sign painting data;

transferring the cut-out and painted appliqué element to a base material; and automatically stitching the appliqué element to the base material in accordance with the stitch command data.

8. A process according to claim 7, wherein the sign painting machine is a numerically controlled air brush painting machine.

* * * * *